US006422433B2

(12) United States Patent
Evans et al.

(10) Patent No.: US 6,422,433 B2
(45) Date of Patent: Jul. 23, 2002

(54) DISPENSING CAP WITH FLEXIBLE SEALING POST

(75) Inventors: Christopher T. Evans; Christopher Gieda, both of Long Valley, NJ (US)

(73) Assignee: Sussex Technologies, Inc., Sparta, NJ (US)

( * ) Notice: Subject to any disclaimer, the term of this patent is extended or adjusted under 35 U.S.C. 154(b) by 0 days.

(21) Appl. No.: 09/872,511

(22) Filed: Jun. 1, 2001

Related U.S. Application Data

(60) Provisional application No. 60/209,271, filed on Jun. 2, 2000.

(51) Int. Cl.[7] ..... B65D 47/00

(52) U.S. Cl. ..... 222/548; 222/547; 222/531; 222/529; 222/507

(58) Field of Search ..... 222/548, 531, 222/505, 507, 547, 528, 529, 519, 521, 522; 251/341, 342

(56) References Cited

U.S. PATENT DOCUMENTS 2,885,128 A * 5/1959 Zimmerli ..... 222/541
2,974,835 A * 3/1961 Herbrick ..... 222/507
3,123,259 A * 3/1964 Musel et al. ..... 222/521
3,221,952 A * 12/1965 De See ..... 222/525
3,294,293 A * 12/1966 Johns ..... 222/507
3,337,098 A * 8/1967 Johns ..... 222/505
3,357,604 A * 12/1967 Barker ..... 222/402.23
4,141,475 A * 2/1979 Nilson ..... 222/494
4,304,342 A * 12/1981 Morane ..... 222/402.23
4,690,304 A * 9/1987 Morel ..... 222/44
5,135,139 A * 8/1992 Krawagna ..... 222/520
5,181,632 A 1/1993 Latter

* cited by examiner

*Primary Examiner*—William C. Doerrler
*Assistant Examiner*—Frederick C Nicolas
(74) *Attorney, Agent, or Firm*—Duane Morris LLP

(57) ABSTRACT

A method and apparatus for dispensing a fluid product, the apparatus including a dispenser cap including a substantially cylindrical base portion including a flexible post protruding therefrom, and a substantially cylindrical cover portion which is shaped to fit overtop of the substantially cylindrical base portion, said substantially cylindrical cover portion including a frustoconical portion extend therefrom which receives the flexible post.

14 Claims, 6 Drawing Sheets

DISPENSING CAP WITH FLEXIBLE SEALING POST

RELATED APPLICATIONS

The present application claims benefit under 35 U.S.C. § 120 of U.S. Provisional application Ser. No. 60/209,271, filed on Jun. 2, 2000.

FIELD OF THE INVENTION

This invention relates to a device and method for dispensing fluid products, such as liquids, pastes and powders.

BACKGROUND OF THE INVENTION

Products such as condiments (e.g., mustard, ketchup, and relish), shampoo, toothpaste, and other products are often packaged in dispensers (e.g., bottles) with 'twist-on/twist-off' caps. Such 'twist' caps typically comprise a base portion and a rotating portion, such that the rotating portion rotates with respect to the base portion to either permit or restrict flow of a substance through the cap. Most mustard dispensers on the market today include 'twist'-type caps or closures. By rotating the 'twist' caps to an open position, and inverting and squeezing the dispenser, the substance contained in the dispenser may be distributed.

A problem with some conventional 'twist' closures is that the means for sealing the closure does not provide an effective seal, thus leakage of the fluid product stored therein may occur. Moreover, if an effective seal is not created, leakage of air into the container in which the fluid product is disposed may cause the product's effective lifespan to be significantly decreased. Additionally, most conventional 'twist-on/twist-off' caps have base and rotating portions that are separated from one another when the cap is in the 'open' position, thus causing an unsightly gap to be formed between the base and rotating portions. Besides the unsightliness, this gap creates an instability in the cap, such that the rotating portion is extremely likely to become separated from the base portion.

Thus, there is presently a need for a 'twist' cap with an effective sealing member.

SUMMARY OF THE INVENTION

The present invention comprises a method and apparatus for dispensing a fluid product, the apparatus including a dispenser cap including a substantially cylindrical base portion including a flexible post protruding therefrom, and a substantially cylindrical cover portion which is shaped to fit overtop of the substantially cylindrical base portion, said substantially cylindrical cover portion including a frustoconical portion extending therefrom which receives the flexible post.

The above and other advantages and features of the present invention will be better understood from the following detailed description of the exemplary embodiments of the invention which is provided in connection with the accompanying drawings.

BRIEF DESCRIPTION OF THE DRAWINGS

FIG. 1(*b*) shows a top plan view of the base portion shown in FIG. 1(*a*).

FIG. 2(*b*) shows a top plan view of the cover portion shown in FIG. 2(*a*).

DETAILED DESCRIPTION

The present invention comprises a method and apparatus for dispensing fluid products (e.g., liquids, pastes, powders, etc.). The present invention may be utilized as an integral part of a container holding the fluid products, or as a separate member which may be coupled (e.g., screwed on) to a container holding the fluid products.

Figure 1A:
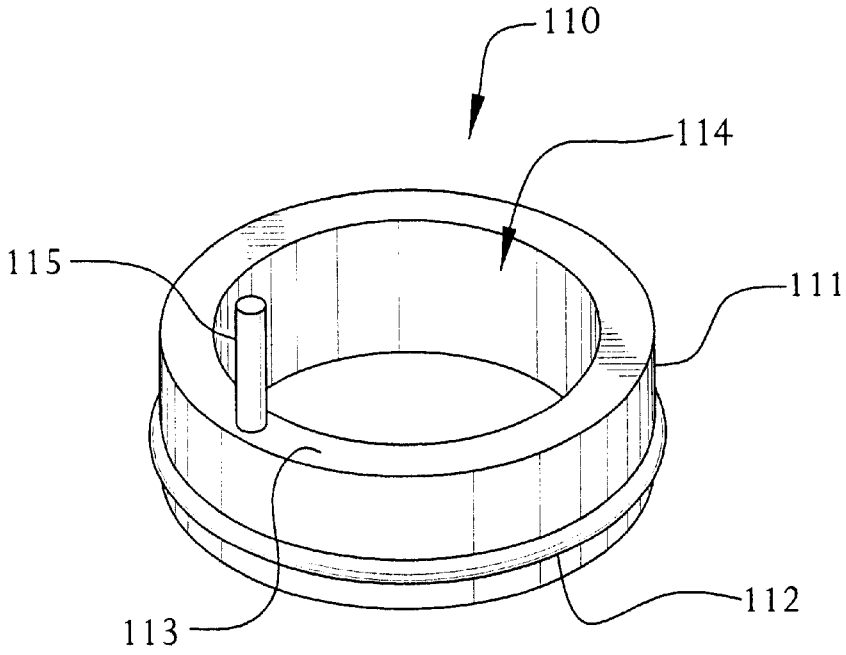
FIG. 1(*a*) shows a side elevation view of a base portion of a dispenser cap according to a first exemplary embodiment of the invention.
Figure 1B:
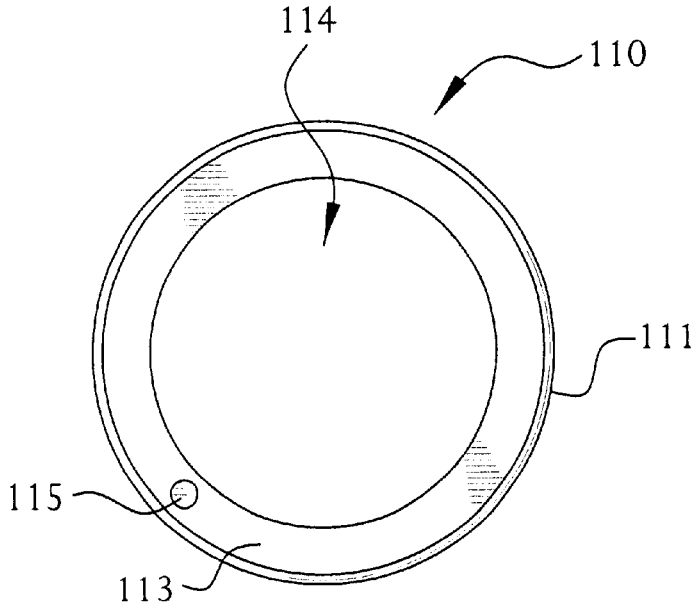
Figure 2A:
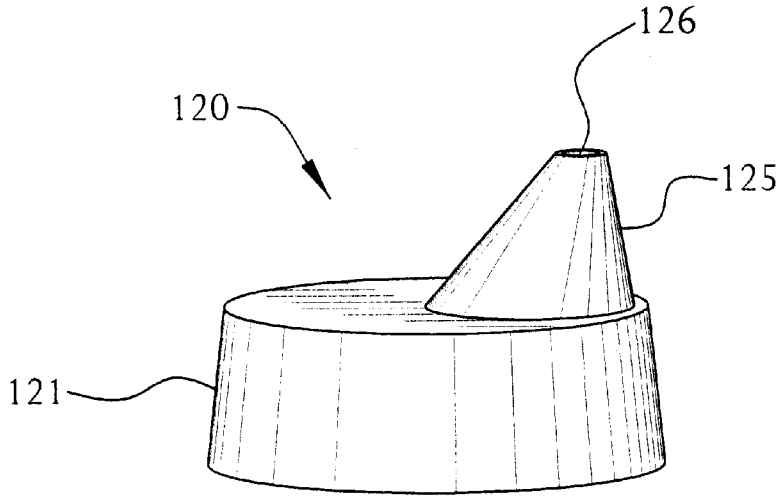
FIG. 2(*a*) shows a side elevation view of a cover portion of a dispenser cap according to a first exemplary embodiment of the invention.
Figure 2B:
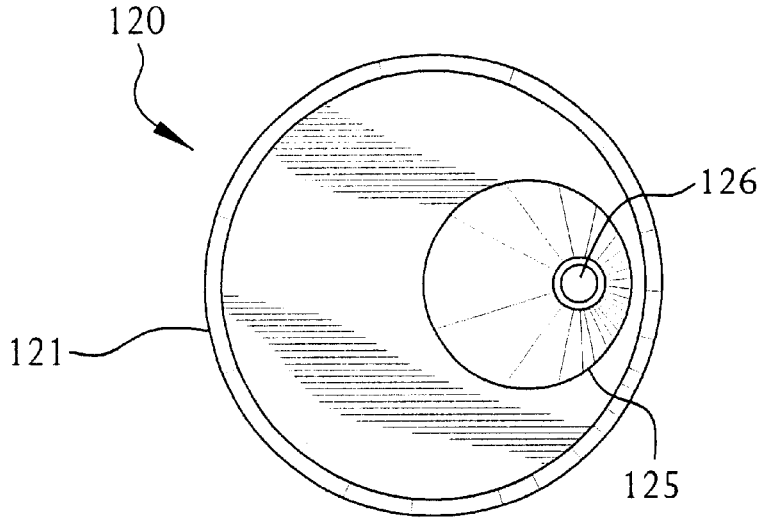

FIGS. 1–2 show a dispenser cap 100 according to a first exemplary embodiment of the present invention. The cap 100 is comprised of two separate portions: a base portion 110 (FIGS. 1(*a*), 1(*b*)) and a cover portion 120 (FIGS. 2(*a*), 2(*b*)).

FIGS. 1(*a*) and 1(*b*) show details of a base portion 110 of the cap 100. The base portion 110 preferably comprises a substantially cylindrical member 111 with a flexible post 115 extending therefrom. The base portion 110 also includes a substantially cylindrical raised bead 112 formed around the exterior of the substantially cylindrical member 111 which is used for connecting the base portion to the cooperating cover portion 120 (explained below). The flexible post 115 preferably extends from a 'shelf' or 'mooring area' 113 of the substantially cylindrical member 111. Although the flexible post 115 may be formed in various shapes, the flexible post is preferably formed in a substantially cylindrical, as shown in FIGS. 1(*a*) and 1(*b*). The substantially cylindrical member 111 also includes a centrally disposed opening 114 therein, which allows fluid products to flow therethrough. The base portion 110 may be formed entirely of plastic material, where flexible post 115 is formed in such a geometry so as to have more flexibility than the remainder of the base portion. The substantially cylindrical portion 111 may be formed of a harder plastic material, such as the types used in most conventional closures (e.g., conventional twist on/twist off mustard caps). The substantially cylindrical portion 111 may also include threading on an interior surface thereof for securing the base portion 110 to the mouth of a threaded container. Additionally, the base portion 110 may include striations on the exterior surface thereof, thus making it easier for a user to grip and twist the base portion when securing the base portion to the mouth of a threaded container.

FIGS. 2(*a*) and 2(*b*) show details of a cover portion 120 of the cap 100. The cover portion 120 preferably comprises a substantially cylindrical member 121 which is shaped to fit overtop of the substantially cylindrical base portion 110. The cover portion 120 also preferably includes a frustoconical portion 125 extending therefrom. The frustoconical portion 125 includes an opening 126 therein for dispensing a fluid product when the cap 100 is coupled to a container. The cover portion 120 also includes a substantially cylindrical recess (not shown) formed around an interior surface thereof, for cooperating with the raised bead 112 formed on the base portion 110, to thereby attach and hold the cover portion to the base portion.

The above-described base and cover portions 110, 120 of the present dispenser cap 100 may be formed from plastics by processes well known in the art, such as molding and extrusion.

Figure 3:
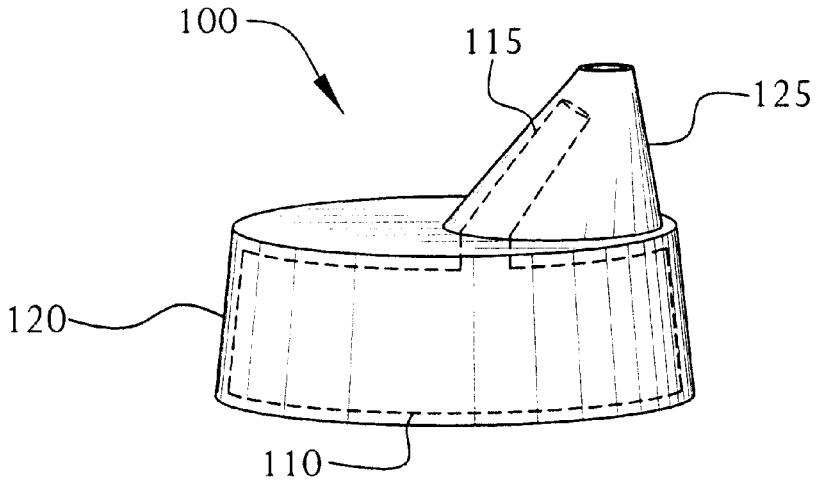
FIG. 3 shows a side elevation view of a base cap and the cover cap in an 'open' position.
Figure 4:
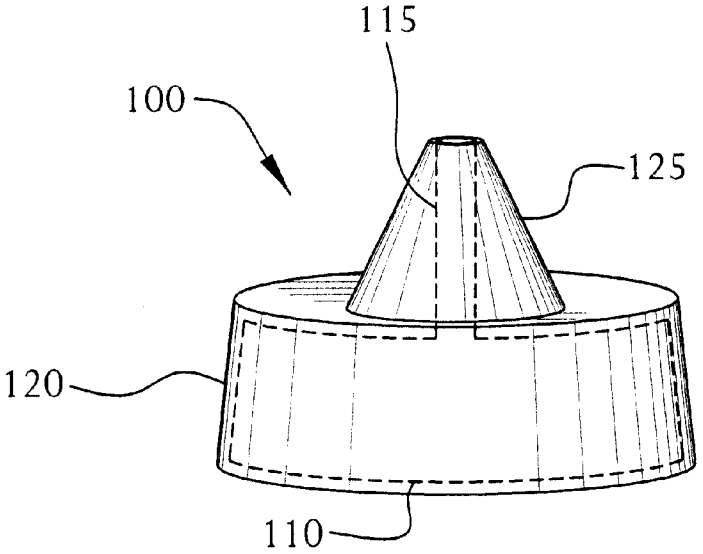
FIG. 4 shows a side elevation view of a base cap and the cover cap in a 'closed' position.

As shown in FIGS. 3 and 4, when the base portion 110 and cover portion 120 are coupled to one another, the flexible post 115 works in conjunction with the opening 126 formed in the frustoconical portion 125 of the cover portion to either permit or prohibit a fluid product from being dispensed. When the cap 100 is coupled to a container housing a fluid product (e.g., mustard), the base portion 110 and the cover portion 120 are rotatable with respect to one another to either permit or inhibit flow of the fluid product through the cap.

FIG. 4 shows a 'closed' position of the cap 100, where the flexible post 115 completely occupies the opening 126 of the cover cap. Once the cover portion 120 is twisted with respect to the base portion 110, as shown in FIG. 3, the flexible post 115 bends with respect to the base portion 110, and becomes partially removed from the opening 126. The bending of the flexible post 125 allows fluid product to flow out of the opening 126 in the cover portion 120.

Figure 5:
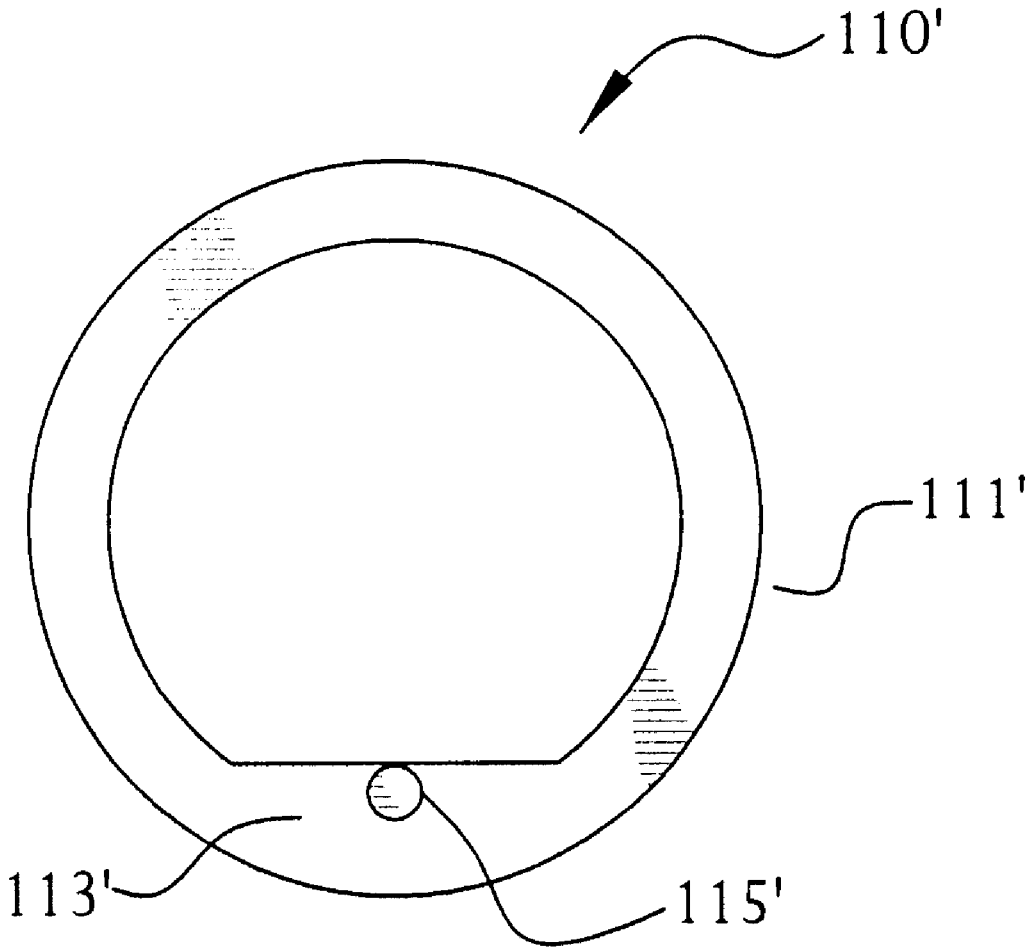
FIG. 5 shows a top view of a base portion with post shelf according to a second exemplary embodiment of the present invention.

It will be noted that in the embodiment described above, the flexible post 115 lies on a shelf portion 113 of the base member 111 which has a thickness which is the same as the remainder of the base member. FIG. 5 shows a base portion 110' with a post 'shelf' 113' which is made wider than the remainder of the base member 111'. It should be noted that the post shelves shown in FIGS. 1(*a*), 1(*b*) and 5 are merely exemplary, and that the geometry and flexibility of the post shelf may be altered depending upon application (e.g., cover caps with wider orifices may require posts with larger diameters, and therefore wider post shelves).

Figure 6:
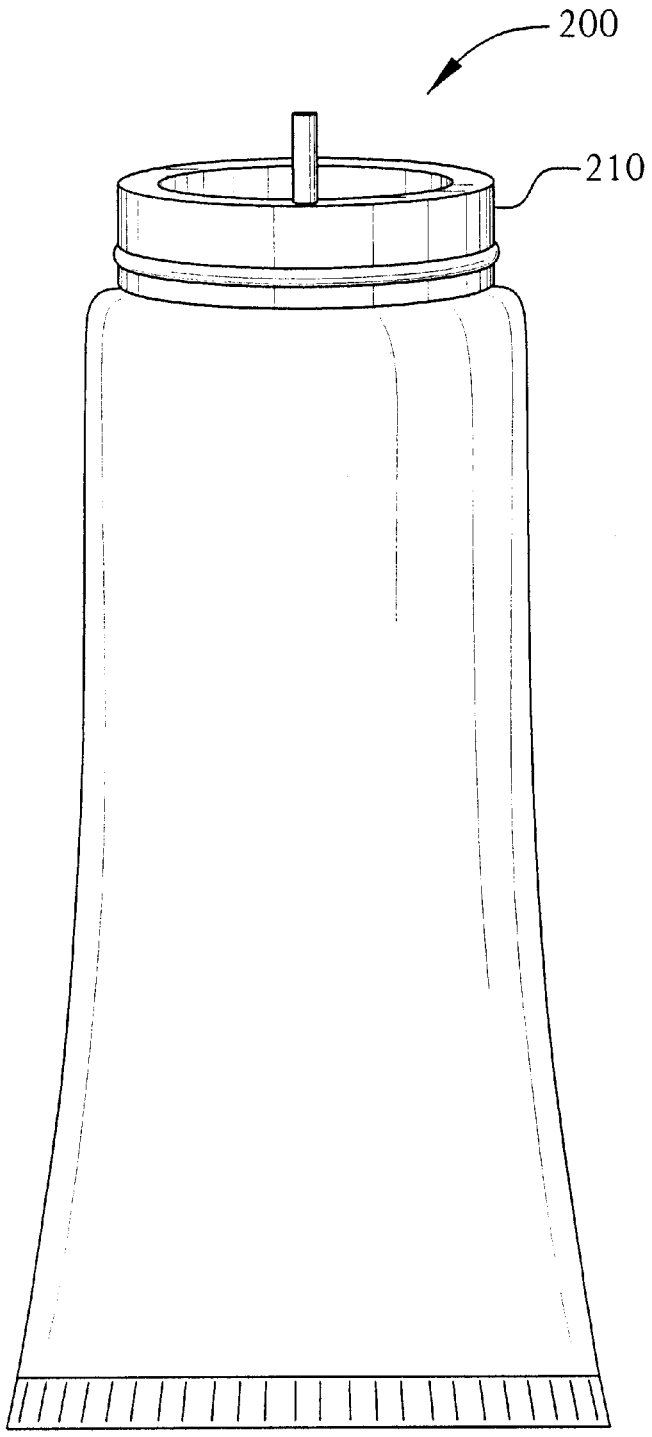
FIG. 6 shows a side elevation view of a squeeze tube according to the present invention.

FIG. 6 shows a first exemplary container 200 in accordance with the present invention. The container 200 preferably comprises a squeeze tube in the embodiment shown, but may comprise any type of fluid product storage container. The container 200 includes a base portion 210 (as described above; reference numeral 110) formed as an integral portion thereof. Thus, in order to form a dispenser, one need only add thereto the cover portion 120 described above. As discussed above, the cover portion 120 will 'snap-fit' to the base portion 210 through a raised bead 212 formed on the base portion.

Figure 7:
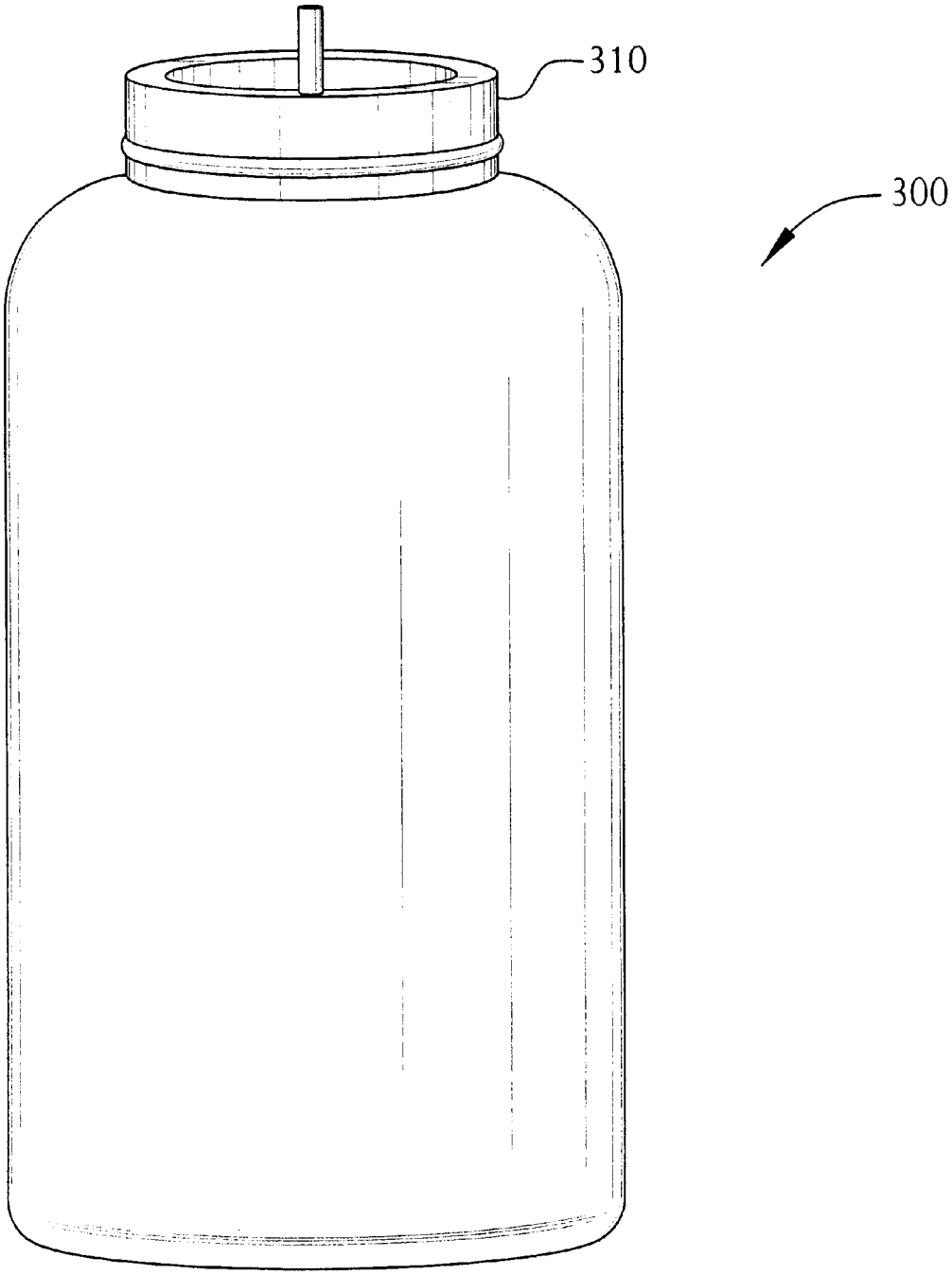
FIG. 7 shows a side elevation view of a bottle according to the present invention.

FIG. 7 shows a second exemplary container 300 in accordance with the present invention. The container 300 preferably comprises a bottle in the embodiment shown, but may comprise any type of fluid product storage container. The container 300 includes a base portion 310 (as described above; reference numeral 110) formed as an integral portion thereof. Thus, in order to form a dispenser, one need only add thereto the cover portion 120 described above. As discussed above, the cover portion 120 will 'snap-fit' to the base portion 310 through a raised bead 312 formed on the base portion It should be noted that the geometry, mounting point, and flexibility of the post may be altered from what is shown and described above without departing from the scope of the invention. Additionally, although a 'snap-fit' bead (e.g., raised bead 112) is discussed above as the preferred method for attaching the base portion 110 of the cap 100 to the cover portion 120, other methods of attachment known to those skilled in the art may also be used (e.g., reciprocal threading formed on both portions 110, 120, reciprocal protuberances formed on both portions 110, 120, etc.).

Thus, the above-described dispensing cap 100 provides an efficient seal by providing a flexible member (i.e., flexible post 115) which is urged into an orifice (i.e., opening 126) of the cap when the cap is in a rest state (i.e., as shown in FIG. 4). The only time the flexible member is removed from the orifice is when the cover portion of the cap is rotated with respect to the base portion by a user. The rotation of the cover portion in a specified direction (e.g., clockwise) forces the flexible member to bend away from the orifice, thereby allowing a fluid product to flow through the orifice (See FIG. 3). As soon as the cover portion is rotated a specified amount in an opposing direction (e.g., counter-clockwise), the flexible post becomes unbent, and again occupies the orifice, thus creating an effective seal. Since the flexible post tends to want to remain in its rest (i.e., unbent) position, the flexible member will be at all times urged to fill the orifice and maintain the seal. Only when a user supplies sufficient force to bend the flexible member will the flexible member be removed from the orifice, and the seal disengaged.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A dispenser cap comprising:

a substantially cylindrical base portion including a flexible post protruding therefrom; and, a substantially cylindrical cover portion which is shaped to fit overtop of the substantially cylindrical base portion, said substantially cylindrical cover portion including a frustoconical portion extend therefrom which receives the flexible post, wherein twisting of the substantially cylindrical cover portion causes the frustoconical portion thereof to contact an upper portion of the flexible post and cause the upper portion to bend towards the substantially cylindrical base portion.

2. The dispenser cap of claim 1, wherein the substantially cylindrical base portion includes a centrally disposed opening formed therein.

3. The dispenser cap of claim 1, wherein the flexible post comprises a substantially cylindrical member extending from the substantially cylindrical base portion.

4. The dispenser cap of claim 1, further comprising:

a raised bead extending around the periphery of the substantially cylindrical base portion.

5. The dispenser cap of claim 1, wherein the flexible post is formed on a shelf area of the substantially cylindrical base portion, said shelf area having a width which is wider than the remainder of the substantially cylindrical base portion.

6. An apparatus for dispensing fluid substances comprising:

a container for holding a fluid substance; and, a dispensing cap including a substantially cylindrical base portion including a flexible post protruding therefrom; and, a substantially cylindrical cover portion which is shaped to fit overtop of the substantially cylindrical base portion, said substantially cylindrical cover portion including a frustoconical portion extend therefrom which receives the flexible post, wherein twisting of the substantially cylindrical cover portion causes the frustoconical portion thereof to contact an upper portion of the flexible post and cause the upper portion to bend towards the substantially cylindrical base portion.

7. The apparatus of claim 6, wherein the container comprises a squeeze tube.

8. The apparatus of claim 6, wherein the container comprises a bottle.

9. A dispenser comprising:

a body portion; and a cap member, said cap member including a base portion and a cover portion, said base portion of said cap member being integrally formed with said body portion, and wherein said base portion includes a flexible post protruding therefrom, and said cover portion includes a frustoconical portion extend therefrom which receives the flexible post, wherein twisting of the substantially cylindrical cover portion causes the frustoconical portion thereof to contact an upper portion of the flexible post and cause the upper portion to bend towards the substantially cylindrical base portion.

10. The dispenser of claim 9, wherein the substantially cylindrical base portion includes a centrally disposed opening formed therein.

11. The dispenser of claim 9, wherein the flexible post comprises a substantially cylindrical member extending from the substantially cylindrical base portion.

12. The dispenser of claim 9, further comprising:

a raised bead extending around the periphery of the substantially cylindrical base portion.

13. The dispenser of claim 9, wherein the flexible post is formed on a shelf area of the substantially cylindrical base portion, said shelf area having a width which is wider than the remainder of the substantially cylindrical base portion.

14. A method for dispensing a fluid substance from a container, comprising the steps of:

twisting a cover portion of a dispensing cap with respect to a base portion of the dispenser cap so that a flexible post formed on the base portion is removed from an orifice formed in the cover portion, thereby allowing a fluid substance to flow; and twisting the cover portion of the dispensing cap with respect to the base portion of the dispenser cap so that the flexible post formed on the base portion is placed into the orifice formed in the cover portion, thereby prohibiting a fluid substance from flowing, wherein twisting of the cover portion causes a frustoconical portion thereof to contact an upper portion of the flexible post and cause the upper portion to bend towards the base portion.

* * * * *